US006555180B2

(12) United States Patent
Hofmeister et al.

(10) Patent No.: US 6,555,180 B2
(45) Date of Patent: Apr. 29, 2003

(54) SYSTEM AND METHOD FOR DIRECT FABRICATION OF MICRO/MACRO SCALE OBJECTS IN A VACUUM USING ELECTROMAGNETIC STEERING

(75) Inventors: William Hofmeister, Nashville, TN (US); David Gustafson, Waterloo, IA (US); Bridget Rogers, Nashville, TN (US)

(73) Assignee: Vanderbilt University, Nashville, TN (US)

( * ) Notice: Subject to any disclaimer, the term of this patent is extended or adjusted under 35 U.S.C. 154(b) by 0 days.

(21) Appl. No.: 10/030,490

(22) PCT Filed: Jun. 4, 2001

(86) PCT No.: PCT/US01/17974

§ 371 (c)(1),
(2), (4) Date: Oct. 25, 2001

(87) PCT Pub. No.: WO01/94030

PCT Pub. Date: Dec. 13, 2001

(65) Prior Publication Data

US 2003/0008074 A1 Jan. 9, 2003

Related U.S. Application Data

(60) Provisional application No. 60/208,862, filed on Jun. 2, 2000.

(51) Int. Cl.[7] ..... B05D 1/04; B05B 5/025

(52) U.S. Cl. ..... 427/475; 427/485; 427/598; 427/294; 118/50.1; 118/623; 118/624; 118/625

(58) Field of Search ..... 427/475, 483, 427/485, 416, 561–562, 598, 595, 294; 118/50.1, 623, 624, 625; 361/225–229

(56) References Cited

U.S. PATENT DOCUMENTS

| | | | | |
|---|---|---|---|---|
| 4,958,058 A | | 9/1990 | Scheidt et al. | 219/121.6 |
| 5,162,969 A | * | 11/1992 | Leung | |
| 5,229,171 A | * | 7/1993 | Donovan et al. | |
| 5,344,676 A | * | 9/1994 | Kim et al. | |
| 5,847,357 A | | 12/1998 | Woodmansee et al. | 219/121.65 |
| 6,296,910 B1 | * | 10/2001 | Choy et al. | |

* cited by examiner

*Primary Examiner*—Fred J. Parker
(74) *Attorney, Agent, or Firm*—Waddey & Patterson; Larry W. Brantley

(57) ABSTRACT

A system and method for directing metal or ceramic particles toward a substrate (18) in a vacuum chamber includes a powder hopper (11), an enclosure (12) containing multiple differentially pumped vacuum chambers (19), a charging lamp (13), a tube (14), multiple charging and heating diodes 15, and an electromagnetic field generating device (EFGD) (17). The hopper (11) holds metal or ceramic particles, the chambers (19) propel the particles through the tube (14) towards substrate (18) positioned close to the tube, charging lamp (13) charges the particles, diodes (15) are used to heat the particles, and the EFGD (17) controls the direction of the particles propelled out of the tube.

22 Claims, 1 Drawing Sheet

Figure 1:
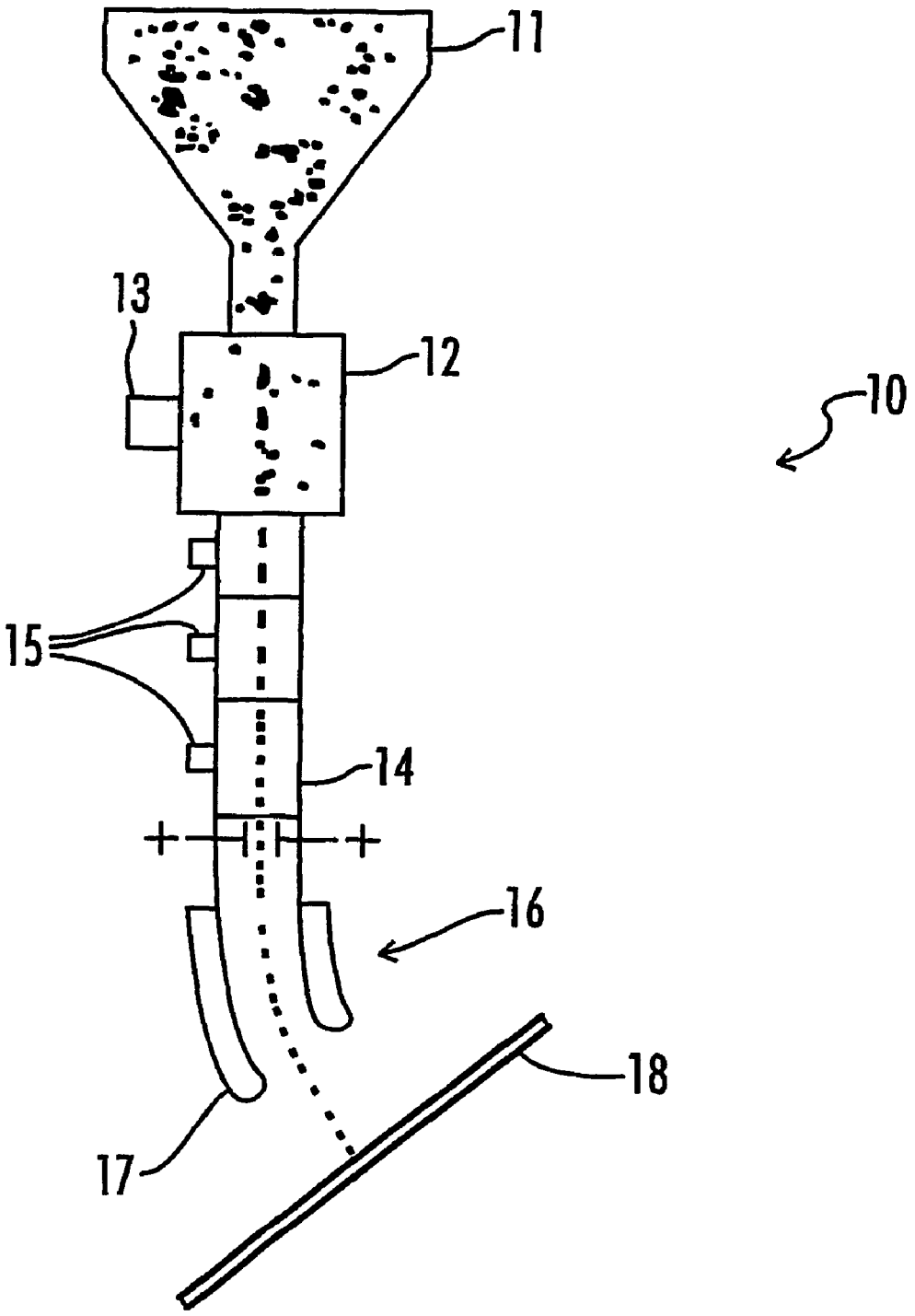

SYSTEM AND METHOD FOR DIRECT FABRICATION OF MICRO/MACRO SCALE OBJECTS IN A VACUUM USING ELECTROMAGNETIC STEERING

This application claims the benefit of U.S. Provisional Application No. 60/208,862, filed Jun. 2, 2000 and PCT International Application PCT/US01/17974, filed Jun. 4, 2001, wherein the United States was a designated country.

TECHNICAL FIELD

The present invention relates generally to systems and methods for direct fabrication of micro- and macro-scale objects in a vacuum. More specifically, the present invention pertains to systems and methods for precisely directing metallic and ceramic powders for deposition on a substrate to form micro- and macro-scale objects in a vacuum.

BACKGROUND ART

In co-pending PCT Patent Application Serial No. PCT/US01/12952, filed on Apr. 20, 2001 designating the United States and entitled "Method and System for Thick-Film Deposition of Ceramic Materials" (hereinafter the "PCT Application"), a system and method for fabricating micro- and macro-scale objects in air is disclosed. In brief the system described in the PCT Application propels metal or ceramic particles toward a substrate, melts the particles using a laser beam to form liquid droplets as the particles travel toward the substrate, and undercools the droplets before they impact the substrate. The undercooling of the droplets is critical to the formation of films and objects having desired properties. The undercooling is a function of the temperature of the droplets and the distance between the substrate and the point where the particles exit the laser beam, i.e., the working distance. The undercooling is also a function of the size and the particles. The PCT Application is hereby incorporated by reference in its entirety.

Fabricating micro-and macro scale objects in air using the system described in the PCT Application, however, presents problems. First, contaminants, such as oxygen or nitrogen, in the air come into contact with the liquid droplets, affecting the properties of the resulting film or object. Second, the size of particles used with the system is limited by the fact that the liquid droplets are subject to Is conduction cooling in the air. As explained in the PCT Application, the undercooled temperature of the liquid droplets upon impact with the substrate is critical to the formation of films and objects having desired properties. In some cases, where very small particles must be used in order to fabricate a desired type of object and the working distance must be a certain minimum distance in order to fabricate the object properly, conduction cooling causes the liquid droplets to cool too rapidly and to have an undesirable undercooled temperature upon impact with the substrate. Thus, there is a need for a way to reduce or eliminate contaminants and conduction cooling of the liquid droplets in the system described in the PCT Application.

In addition, the system described in the PCT Application does not include a device that can be used to direct the particles, and in turn the liquid droplets, toward a specific location on the substrate. Such a device is necessary in order to fabricate micro- and macro-scale objects having various shapes and sizes. Thus, there is also a need for a way to direct the particles and liquid droplets toward specific locations on the substrate.

What is needed, then, is a system and method for reducing or eliminating contamination and conduction cooling, and for directing particles and liquid droplets toward specific locations on a substrate.

DISCLOSURE OF THE INVENTION

Accordingly, one object is to provide a system and method for reducing or eliminating contaminants in particles and liquid droplets used to fabricate micro- and macro-scale objects.

Another object is to provide a system and method for reducing or eliminating conduction cooling of liquid droplets used to fabricate micro- and macro-scale objects.

Still another object of the present invention is to provide a system and method for directing particles and liquid droplets to specific locations on a substrate in order to fabricate micro- and macro-scale objects.

These and other objects are satisfied by a system enclosed in a vacuum chamber that includes a powder hopper, an enclosure containing a plurality of differentially pumped vacuum chambers, a tube, a charging lamp, a plurality of charging and heating diodes, and an electromagnetic steering device. The powder hopper is adapted to hold a plurality of metal or ceramic particles and the plurality of differentially pumped vacuum chambers are adapted to draw the particles out of the hopper and to propel the particles down the tube, which has one end connected to the enclosure and a second end pointing toward a substrate. The charging lamp is connected to the enclosure and is adapted to charge the particles as they pass through the enclosure. The charging and heating diodes are adapted to heat the particles as they pass through the tube. The electromagnetic field generating device is adapted to generate a steering magnetic field, which is used to direct the particles leaving the tube toward a specific location on the substrate. The electromagnetic field generating device can be adjusted to vary the magnetic field in order to direct the particles toward various locations on the substrate.

By enclosing the system in a vacuum, contaminants and conduction cooling are significantly reduced or eliminated. As an additional benefit, implementing the system in a vacuum allows the system to be used with other fabrication processes, such as vapor deposition processes, which are performed in a vacuum.

BRIEF DESCRIPTION 0F THE DRAWING

FIG. 1 is a schematic diagram of one embodiment of the present invention.

BEST MODE FOR CARRYING OUT THE INVENTION

Referring to FIG. 1, one embodiment of the system 10 of the present invention includes a powder hopper 11, an enclosure 12 containing differentially pumped chambers 19 having apertures 20, a charging lamp 13 connected to the enclosure, a cylindrical tube 14 connected to the enclosure 12, a plurality of charging and heating diodes 15 connected to the tube 14, and an electromagnetic field generating device 17 connected to a steering portion of the tube 16, which is simply a curved portion of the tube 14. The system 10 is contained within a conventional vacuum chamber (not shown), which creates a vacuum around the system 10.

The powder hopper 11 contains powder-sized metal or ceramic particles (not shown). The enclosure 12 is connected to the powder hopper 11 and the apertures 20 of the differentially pumped chambers 19 are connected to vacuum pumps (not shown). Vacuum pumps are well known in the art and the applicant contemplates using conventional vacuum pumps with this invention. The vacuum pumps are used to create different vacuums in each of the differentially pumped chambers 19 thereby creating a pressure differential that draws the particles (not shown) out of the powder hopper 11 and propels the particles through the differentially pumped chambers 19 and through the tube 14, which is connected to one of the differentially pumped chambers 19. By adjusting the pressure in the differentially pumped chambers 19, the particles can be drawn out of the powder hopper 11 and propelled through the differentially pumped chambers 19 and tube 14 at various speeds.

For example, in one embodiment the enclosure includes a first differentially pumped vacuum chamber (not shown) connected in series with a second differentially pumped vacuum chamber (not shown). The first differentially pumped vacuum chamber is connected to the powder hopper 11 using a capillary tube (not shown) and the second differentially pumped vacuum chamber is connected to the tube 14. The powder hopper has pressure of approximately 100 torr, the first differentially pumped vacuum chamber has a pressure of approximately $10^{-2}$ torr, and the second differentially pumped vacuum chamber has a pressure of approximately $10^{-5}$ torr. As a result, a pressure differential is created between the powder hopper 11 and the second differentially pumped vacuum chamber that draws the particles out of the powder hopper 11 and propels the particles through the first differentially pumped vacuum chamber, the second differentially pumped vacuum chamber, and the tube 14. In alternative embodiments, more than two differentially pumped vacuum chambers may be used, with pressures in these chambers ranging from 10 torr to $10^{-5}$ torr.

The charging lamp 13 charges the particles as they pass through the enclosure 12 containing the differentially pumped chambers 19. The charge placed on the particles should be sufficient to ensure that the particles can be controlled by a steering magnetic field, which is generated by the electromagnetic field generating device 17 discussed in more detail below. The required charge will vary based on the size of the particles that are being used with the invention, which can vary from powder-sized to as small as one micron. Although the charging lamp 13 is shown in FIG. 1 connected to the enclosure 12, the charging lamp 13 can be connected to the tube 14 as well.

The charging and heating diodes 15 charge and heat the particles as they pass through the tube 14. The primary function of the charging and heating diodes 15 is to heat the particles as they pass through the tube 14. In some embodiments, however, no heating may be necessary. For example, in applicant's co-pending PCT Application Serial No. PCTIUS10/12952, filed on Apr. 20, 2001 designating the United States and entitled "Method and System for Thick-Film Deposition of Ceramic Materials" (hereinafter the PCT Application), a system for fabricating micro- and macro-scale objects by melting metal or ceramic particles with a laser beam is disclosed. As discussed in that application, it is sometimes beneficial to pre-heat the particles to ensure that the particles completely melt while passing through the laser beam. Accordingly, the present invention includes the charging and heating diodes 15 in order to pre-heat the particles as they pass through the tube 14. The amount of pre-heating will vary depending upon particle size and other factors as described in the PCT Application. In other embodiments where no heating is required, the charging and heating diodes 15 can be excluded.

The electromagnetic field generating device (EFGD) 17 generates a steering magnetic field (not shown) that is used to direct the charged particles to specific locations on a substrate 18 positioned close to the tube 14. The use of electromagnetic field generating devices to generate steering magnetic fields for controlling the direction of charged particles is well known in the art and the applicant contemplates using a conventional electromagnetic field generating device. For example, in one embodiment, the EFGD 17 is a quadrapole electrostatic steering device. In another embodiment, the EFGD 17 is simply a pair of metal plates positioned near the steering portion of the tube 14. The metal plates are connected to a voltage source (not shown) that generates a charge on one plate that attracts the charged particles and a charge on the other plate that repels the charged particles. In this manner, the charged particles can be directed toward a specific location on the substrate 18. In addition, the EFGD 17 can be adjusted to vary the steering magnetic field so that the charged particles leaving the tube 14 can be directed toward specific locations on the substrate 18 in order to form three-dimensional structures having a predetermined size and shape.

In one embodiment, the powder hopper 11 is simply a small stainless steel vacuum chamber and the differentially pumped chambers 19 include one large stainless steel vacuum chamber, both of which are manufactured by MDC Vacuum Products Corporation of Hayward, Calif., www.mdc-vacuum.com. The powder hopper 11 is connected to the differentially pumped chamber 19 using a small capillary tube (not shown) having a diameter of 200 microns. The pressure in the powder hopper is 100 torr and the pressure in the differentially pumped chamber 19 is $10^{-6}$ torr, which creates a pressure differential that draws the particles out of the powder hopped and propels the particles through the differentially pumped chamber 19. The pressure differential propels the particles through the differentially pumped chamber 19 and through the tube 14 toward the substrate 18. In this embodiment, the tube 14 is also a small capillary tube having a diameter of 200 microns, the charging lamp 13 is an ultraviolet lamp, and the charging and heating diodes 15 are infrared diodes. Finally, the EFGD 17 is a conventional quadrapole electrostatic steering device.

Thus, although there have been described particular embodiments of the present invention of a new and useful System and Method for Direct Fabrication of Micro/Macro Scale Objects in a Vacuum Using Electromagnetic Steering, it is not intended that such references be construed as limitations upon the scope of this invention except as set forth in the following claims.

What is claimed is:

1. A method of fabricating objects in a vacuum chamber, comprising the steps of:

generating a pressure differential using differentially pumped vacuum chambers;

propelling particles of a powder in a direction toward a substrate using the pressure differential;

charging the particles using a charging lamp;

generating a steering field using an electromagnetic field generating device; and directing the charged particles toward specific locations on the substrate by adjusting the steering field.

2. The method of claim 1, further comprising the step of heating the particles using a plurality of heating lamps.

3. The method of claim 2, wherein the step of generating a pressure differential includes the steps of:

generating a vacuum at a first predetermined pressure in a first differentially pumped vacuum chamber; and generating a vacuum at a second predetermined pressure in a second differentially pumped vacuum chamber.

4. The method of claim 3, wherein the step of charging the particles includes the step exposing the particles to ultraviolet light.

5. The method of claim 2, wherein the step of heating the charged particles includes the step of exposing the charged particles to infrared light.

6. A method of fabricating objects in a vacuum chamber, comprising the steps of:

generating a pressure differential by generating a vacuum at a first predetermined pressure in a first differentially pumped vacuum chamber and generating a vacuum at a second predetermined pressure in a second differentially pumped vacuum chamber;

propelling particles of a powder in a direction toward a substrate using the pressure differential;

charging the particles by exposing the particles to ultraviolet light;

heating the charged particles by exposing the particles to infrared light;

generating a steering field using an electromagnetic field generating device; and directing the charged particles toward specific locations on the substrate by adjusting the steering field.

7. A system for fabricating objects in a vacuum chamber, comprising:

feeding means for propelling particles of a powder in a direction toward a substrate positioned proximate the feeding means; and steering means connected to the feeding means for controlling the direction of particles propelled out of the feeding means.

8. The system of claim 6, wherein the feeding means includes:

a container for holding particles of a powder; and a plurality of differentially pumped vacuum chambers connected in series for generating a pressure differential to draw the particles out of the container and to propel the particles toward the substrate.

9. The system of claim 7, wherein the steering means includes:

a charging lamp connected to the feeding means for charging the particles; and an electromagnetic field generating device connected to the feeding means for generating a steering magnetic field, the steering magnetic field adapted to control the direction of charged particles propelled out of the feeding means.

10. The system of claim 8, further including a heating means connected to the feeding means for heating charged particles passing through the feeding means.

11. The system of claim 9, wherein the charging lamp includes an ultraviolet lamp.

12. The system of claim 10, wherein the heating means includes a plurality of infrared diodes.

13. The system of claim 11, wherein the electromagnetic field generating device includes a quadrapole electrostatic steering device.

14. A system for fabricating objects in a vacuum chamber, comprising:

a container for holding particles of a powder;

a plurality of differentially pumped vacuum chambers connected to the container and in series for generating a pressure differential to draw the particles out of the container and to propel the particles through a tube connected to the vacuum chambers in a direction toward a substrate;

a charging lamp connected to the vacuum chambers for charging the particles; and an electromagnetic field generating device connected to the tube for generating a steering magnetic field, the steering magnetic field adapted to control the direction of charged particles propelled out of the tube.

15. The system of claim 14, further including a plurality of heating lamps connected to the tube for heating charged particles passing through the tube.

16. The system of claim 15, wherein the charging lamp includes an ultraviolet lamp.

17. The system of claim 16, wherein the plurality of heating lamps includes a plurality of infrared diodes.

18. The system of claim 17, wherein the electromagnetic field generating device includes a quadrapole electrostatic steering device.

19. A system for fabricating objects in a vacuum chamber, comprising:

a hopper for holding particles in a powder;

an enclosure containing a plurality of differentially pumped chambers connected to the hopper for drawing the particles out of the hopper and propelling the particles through a tube connected to the enclosure in a direction toward a substrate positioned proximate the tube;

a charging lamp connected to the enclosure for charging the particles;

a plurality of heating lamps connected to the tube for heating the charged particles passing through the tube; and an electromagnetic field generating device connected to a steering portion of the tube for generating a steering magnetic field for use in controlling the direction of the charged particles exiting the steering portion of the tube.

20. The system of claim 19, wherein the charging lamp includes an ultraviolet lamp.

21. The system of claim 20, wherein the plurality of heating lamps includes a plurality of infrared diodes.

22. The system of claim 21, wherein the electromagnetic field generating device includes a quadrapole electrostatic steering device.

* * * * *